United States Patent [19]

Busker et al.

[11] Patent Number: 5,010,840

[45] Date of Patent: Apr. 30, 1991

[54] SHORT DWELL COATER APPARATUS

[75] Inventors: L. H. Busker; E. W. Wight, both of Rockton, Ill.

[73] Assignee: Beloit Corporation, Beloit, Wis.

[21] Appl. No.: 429,260

[22] Filed: Oct. 30, 1989

[51] Int. Cl.[5] ..... B05D 1/02

[52] U.S. Cl. ..... 118/421; 118/410; 118/413; 427/356

[58] Field of Search ..... 427/356; 118/410, 413, 118/421

[56] References Cited

U.S. PATENT DOCUMENTS

| | | | |
|---|---|---|---|
| 4,125,641 | 11/1978 | Wallsten | 427/296 |
| 4,452,833 | 6/1984 | Holt | 118/410 X |
| 4,495,888 | 1/1985 | Wöhrle et al. | 118/410 |
| 4,594,963 | 6/1986 | Krautzberger | 118/413 X |

*Primary Examiner*—Shrive Beck
*Assistant Examiner*—Alain Bashore
*Attorney, Agent, or Firm*—Dirk J. Veneman; Raymond W. Campbell; David J. Archer

[57] ABSTRACT

A short dwell coater apparatus is disclosed for coating a web with a coating material, the web moving contiguously with a rotating backing roll. The apparatus includes a housing which is disposed on the opposite side of the web relative to the backing roll. The housing defines a chamber is connected to a pressurized source of coating material. The chamber is exposed to the web such that the web supported by the backing roll is coated with the coating material during passage of the web past the coating chamber. Each of a first and second weir extend in a cross-machine direction such that the coating chamber is bounded by the weirs and the web moving between the weirs. The first and second weirs define respectively first and second overflow gaps. The arrangement is such that during use of the apparatus, when the web moves past the coating chamber, coating material is coated onto the web while excess coating material overflows through the first and second gaps for recirculating through the coating chamber. A resilient blade is disposed downstream relative to the second weir. The blade cooperates with the coating material coated onto the web such that the pressure exerted by the coating material on the blade is less than the pressure of the coating material within the coating chamber, so that mottling and streaking of the resultant web is inhibited while maintaining minimum pressure on the blade.

13 Claims, 4 Drawing Sheets

SHORT DWELL COATER APPARATUS

BACKGROUND OF THE INVENTION

1. Field of the Invention

The present invention relates to a short dwell coater apparatus. More particularly, the present invention relates to a short dwell coater apparatus for coating a web with a coating material, the web moving contiguously with a rotating backing roll.

2.Information Disclosure Statement

Before the introduction of short dwell coaters, the coating of a paper web, or the like, was accomplished by rotating a roll within a pan of coating material. The coating material was offset from the roll rotating within the pan to an offset roll. Thereafter, the coating material was transferred to a web moving past and in contact with the coating material on the offset roll. More particularly, the coating material was applied to the web by passing the web through a coating nip defined between the offset roll and a backing roll.

Although pressures in excess of ten pounds per square inch were typically applied at the coating nip, thereby providing sufficient pressure between the coating material and the web, the coating applied to the web suffered from the problem of nonuniformity in a cross-machine direction. Such nonuniformity was mainly due to the uneven distribution of coating material in a cross-machine direction on the offset roll.

Additionally, because of the relatively long residence time of the moving web relative to the coating material, excess quantities of coating material were applied to the web.

With the advent of the so-called "short dwell coater", the aforementioned problems were overcome. The short dwell coater essentially includes a housing defining a coating chamber supplied with a pressurized source of coating material. The web moves between the coating chamber and a backing roll such that coating material is applied to the moving web. A resilient blade is disposed immediately downstream relative to the coating chamber, the blade defining the downstream end of the chamber.

In the prior art, relatively low pressures were applied within the coating chamber, such pressures being less than two pounds per square inch, so that as the web moved past the coating chamber, a very thin coating was applied to the moving web. Due to the aforementioned low coating pressure and the short residence time of the web moving past the coating chamber, the coating material applied to the web was relatively thin with little penetration of the coating material into the fibers of the resultant coated web. Furthermore, the resilient blade metered and smoothed the coating material onto the moving web.

However, with the prior art, short dwell or "short residence time" coaters there exists a problem known as mottling, or streaking, of the resultant coated web. It is understood that such mottling or streaking is caused by the relatively low application pressure within the coating chamber.

According to the present invention, it was discovered that with the aforementioned roll-coating procedure, a relatively high application pressure above ten pounds per square inch permitted absorption of water within the coating material to penetrate the fibers of the moving web, leaving a residual layer of concentrated coating particulate material at the surface. Whereas, in the case of the aforementioned short dwell coater apparatus utilizing a pressure below two pounds per square inch, insufficient application pressure was available to effect adequate bonding between the coating material and the moving web.

In the aforementioned short dwell coaters, if the pressure within the coating chamber were increased in order to reduce mottling and streaking, the increased pressure of the coating material within the coating chamber would have unduly affected the pressure exerted on the resilient blade because the resilient blade was located within the coating chamber.

The present invention seeks to overcome the aforementioned problem by providing a coating chamber with an upstream and a downstream overflow gap so that a relatively high pressure can be applied within the coating chamber, in order to overcome the problem of mottling and streaking. The resilient blade is disposed downstream relative to the downstream overflow gap so that the relatively high pressure of the coating material within the coating chamber does not affect the pressure of the coating material contacting the resilient blade. According to the present invention, the pressure within the coating chamber is within the range of ten to fifty pounds per square inch, whereas the pressure of the coating material between the second or downstream overflow gap and resilient blade is substantially atmospheric. By this means, mottling and streaking of the resultant coated web is inhibited while minimum pressure is applied to the resilient blade, resulting in greater controllability of the resilient blade.

Therefore, it is a primary object of the present invention to overcome the inadequacies of the prior art proposals and to provide a short dwell coater apparatus that provides a considerable contribution to the art of coating a moving web of paper.

Another object of the present invention is the provision of a short dwell coater apparatus which includes a housing defining a coating chamber having an upstream and a downstream end. Said upstream and downstream ends of the coating chamber define first and second weirs extending in a cross-machine direction such that the coating chamber is bounded by the weirs and the web moving between the weirs.

Another object of the present invention is the provision of a short dwell coater in which the first and second weirs define respectively first and second overflow gaps disposed between the respective weirs and the web moving past the respective weir. The arrangement is such that during use of the apparatus when the web moves past a coating chamber, coating material is coated on the web while excess coating material overflows through the first and second gaps for recirculation through the coating chamber.

Another object of the present invention is the provision of a short dwell coater apparatus in which the resilient coating blade is disposed downstream relative to the second weir such that the pressure exerted by the coating material on the blade is less than the pressure of the coating material within the coating chamber, so that mottling and streaking of the resultant web is inhibited while maintaining minimum pressure on the blade.

Another object of the present invention is the provision of a short dwell coater apparatus which includes overflow control means connected to the housing for controllably urging the housing and the first and second weirs radially relative to the backing roll, for controlling the first and second gaps such that the pressure within the coating chamber is controlled. The arrangement is such that when the weirs are urged towards the web, the gaps are decreased and the pressure within the coating chamber is increased.

Another object of the present invention is the provision of a short dwell coater apparatus which includes overflow control means including a frame, the frame defining a cylinder controllably connected to a source of hydraulic pressure, and a piston slidably cooperating with the cylinder. A housing also includes a pivotal bearing which pivotally cooperates with the piston such that the housing is controllably moved relative to a backing roll for controlling the pressure within the coating chamber.

Another object of the present invention is the provision of a short dwell coater apparatus which includes a frame and an overflow control means disposed between the frame and the housing for controllably moving the housing relative to the frame for controlling the pressure within the coating chamber. A blade includes a proximal and a distal end, with the proximal end being secured to the frame and the distal end cooperating with the applied coating material. Additionally, the apparatus includes regulating means disposed between the proximal and distal ends of the blade. The regulating means cooperates with the blade and the frame for regulating the pressure applied by the distal end of the blade on the applied coating. Pressure applied to the distal end of the blade by the applied coating is substantially the same pressure as the pressure of the coating material being recirculated from the second gap to the coating chamber.

Another object of the present invention is the provision of a short dwell coater apparatus in which the pressure within the coating chamber is within the range ten to fifty pounds per square inch, and the pressure of the coating material overflowing through the second gap and contacting the blade is substantially atmospheric, such that the pressure of the coating material contacting the blade is unaffected by the pressure within the coating chamber.

Other objects and advantages of the present invention will be readily apparent to those skilled in the art by consideration of the detailed description contained hereinafter, taken in conjunction with the annexed drawings.

SUMMARY OF THE INVENTION

The present invention relates to a short dwell coater apparatus and method for coating a web with a coating material, the web moving contiguously with a rotating backing roll. The apparatus includes a housing which is disposed on the opposite side of the web relative to the backing roll. The housing defines a coating chamber which has an upstream and a downstream end. The chamber is connected to a pressurized source of coating material. The chamber is exposed to the web such that the web supported by the backing roll is coated with the coating material during passage by the web past the coating chamber. The upstream and downstream ends of the coating chamber define first and second weirs respectively. Each of the weirs extend in a cross-machine direction such that the coating chamber is bounded by the weirs and the web moving between the weirs. The first and second weirs define respectively first and second overflow gaps which are disposed between the respective weirs and the web moving past the respective weirs. The arrangement is such that during use of the apparatus, when the web moves past the coating chamber, coating material is coated onto the web while excess coating material overflows through the first and second gaps for recirculation through the coating chamber.

A resilient blade is disposed downstream relative to the second weir. The blade cooperates with the coating material coated onto the web. The arrangement is such that the pressure exerted by the coating material on the blade is less than the pressure of the coating material within the coating chamber, so that mottling and streaking of the resultant web is inhibited while maintaining minimum pressure on the blade.

In a more specific embodiment of the present invention, the housing also defines a plurality of holes which extend from the coating chamber to the pressurized source for regulating the flow of coating material from the source to the coating chamber.

In another embodiment of the present invention, the housing further defines a plurality of slots which extend from the coating chamber to the pressurized source for regulating the flow of coating material from the source to the coating chamber.

In yet another embodiment of the present invention, the housing also defines a plurality of capillary tubes which extend from the coating chamber to the pressurized source for regulating the flow of coating material from the source to the coating chamber.

In one embodiment of the present invention, the housing further includes a control means which is disposed between the pressurized source and the coating chamber for providing a constant flow of the coating material from the source to the coating chamber.

More specifically, the apparatus includes overflow control means connected to the housing for controllably urging the housing and the first and second weirs radially relative to the backing roll for controlling the first and the second gaps such that the pressure within the coating chambers is controlled. The arrangement is such that when the weirs are urged towards the web, the gaps are decreased and the pressure within the coating chamber is increased.

In one embodiment of the present invention, the overflow control means includes a frame and a wedge-shaped member. The wedge-shaped member is disposed between the housing and the frame with the wedge-shaped member cooperating with the frame and the housing such that when the wedge-shaped member is moved between the frame and the housing, the housing is moved radially relative to the backing roll.

In another embodiment of the present invention, the overflow control means also includes adjustable means extending between the wedge-shaped member and the frame. The adjustable means is threadably disposed relative to the frame such that when the adjustable means is rotated, the wedge-shaped member is moved relative to the housing for controlling the pressure within the coating chamber.

In another embodiment of the present invention, the overflow control means includes a frame and an adjustable screw means extending between the frame and the housing for moving the housing relative to the backing roll for controlling the pressure within the coating chamber.

In yet another embodiment of the present invention, the overflow control means also includes a frame and a hydraulically operated ram extending between the frame and the housing for moving the housing relative to the backing roll for controlling the pressure within the coating chamber.

In another embodiment to the present invention, the overflow control means also includes a frame with the frame defining a cylinder controllably connected to a source of hydraulic pressure. The control means also includes a piston slidably cooperating within the cylinder. The housing also includes a pivotal bearing which pivotally cooperates with a piston such that the housing is controllably moved relative to the backing roll for controlling the pressure within the coating chamber.

The coater apparatus also includes a resilient blade having a proximal and a distal end with the proximal end being secured to the frame and the distal end cooperating with the applied coating material.

The coater apparatus also includes regulating means which are disposed between the proximal and the distal ends of the blade. The regulating means cooperate with the blade and the frame for regulating the pressure applied by the distal end of the blade to the applied coating. The pressure applied to the distal end of the blade by the applied coating material is substantially the same pressure as the pressure of the coating material being recirculated from the second gap to the coating chamber.

More specifically, the regulating means includes a pneumatic tube which extends between the blade between the proximal and distal ends thereof. The tube is connected to a controllable source of pressurized air.

In a preferred embodiment of the present invention, the pressure within the coating chambers is within the range ten to fifty pounds per square inch and the pressure of the coating material overflowing through the second gap and contacting the blade is substantially atmospheric, such that the pressure of the coating material contacting the blade is unaffected by the pressure within the coating chamber.

The present invention also includes a method of coating a web with a coating material, the web moving contiguously with a rotating backing roll, said method including the steps of:

(1) connecting a chamber defined by a housing to a pressurized source of the coating material, the chamber being exposed to the web such that the web supported by the backing roll is coated with the coating material during passage of the web past the coating chamber;

(2) permitting excess coating material to overflow through a first and second gap defined between a first and second weir and the web respectively, such that the excess coating material overflows through the coating chamber; and (3) subsequently contacting the coated web with a resilient blade disposed downstream relative to the second weir, the blade cooperating with the coating material coated onto the web such that the pressure exerted by the coating material on the blade is less than the pressure of the coating material within the coating chamber so that mottling and streaking of the resultant web is inhibited while maintaining minimum pressure on the blade.

Although many modifications and variations of the present invention will be readily apparent to those skilled in the art by a consideration of the detailed description contained hereinafter, taken in conjunction with the annexed drawings, such variations and modifications fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
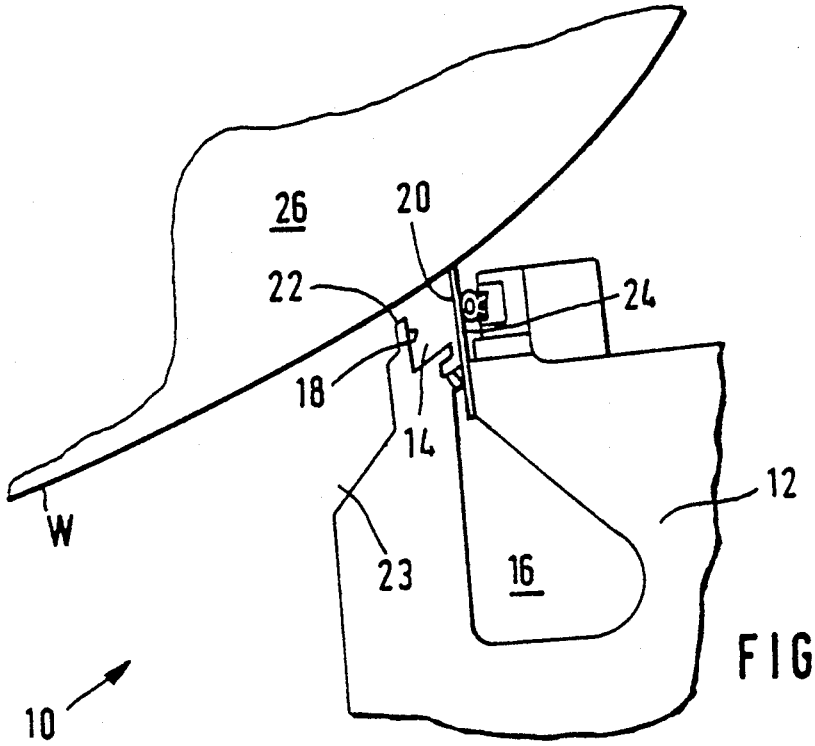
FIG. 1 is a side-elevational view of a typical short dwell coater showing the resilient blade, defining the downstream end of the coating chamber.

FIG. 1 is a side-elevational view of a typical, prior art short dwell coater apparatus generally designated 10. The coater apparatus 10 includes a housing 12 which defines a coating chamber 14 connected to a source 16 of pressurized coating material. The coating chamber 14 includes an upstream and a downstream end 18 and 20. The upstream end defines a weir 22 such that excess material 23 overflows from the coating chamber 14 over the weir 22 and is recirculated to the coating source 16. The downstream end 20 of the coating chamber 14 is bounded by a resilient blade 24 such that in use of the apparatus 10, when a web of paper W moves between the coating chamber 14 and a backing roll 26, coating material is applied to the web W moving between the weir 22 and the blade 24. However, with the prior art short dwell coater shown in FIG. 1, only relatively low pressures are permissible within the coating chamber 14 because if relatively high pressures within the range ten to fifty pounds per square inch were applied within the coating chamber 14, such relatively high pressures would have an adverse effect on the controllability of the resilient blade 24.

Figure 2:
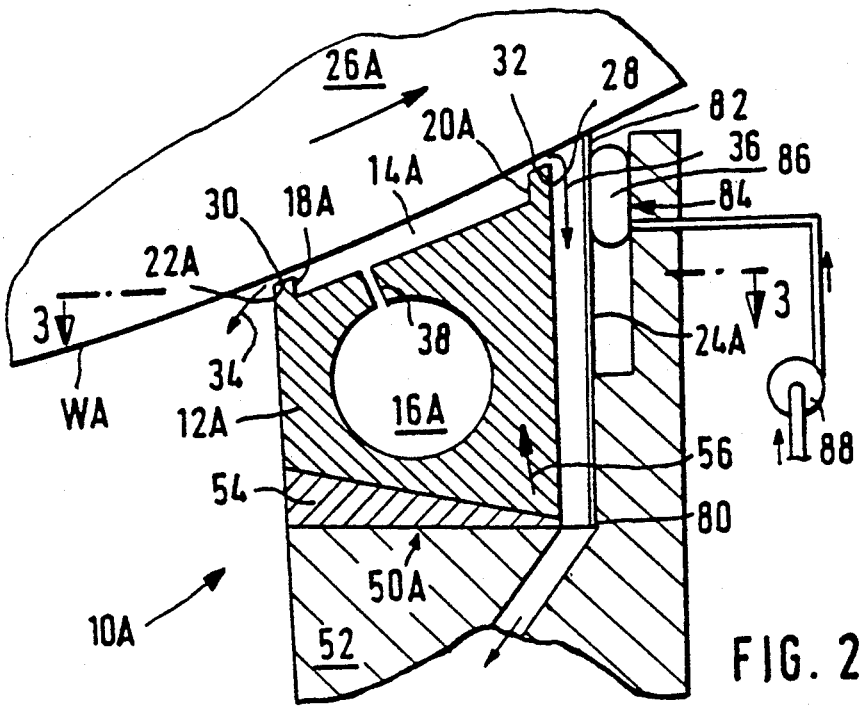
FIG. 2 is a side-elevational view of the short dwell coater apparatus according to the present invention, showing the resilient blade unaffected by the pressure within the coating chamber.

As shown in FIG. 2, the aforementioned problems are overcome according to the present invention by the provision of a short dwell coater apparatus generally designated 10A for coating a web WA with a coating material. The web WA moves contiguously with a rotating backing roll 26A. The apparatus 10A includes a housing 12A which is disposed on the opposite side of the web WA relative to the backing roll 26A. The housing 12A defines a coating chamber 14A having an upstream and a downstream end 18A and 20A. The chamber 14A is connected to a pressurized source 16A of coating material. The chamber 14A is exposed to the web WA such that the web WA supported by the backing roll 26A is coated with the coating material during passage of the web WA past the coating chamber 14A. The upstream and downstream ends 18A and 20A of the coating chamber 14A define a first and second weir 22A and 28. Each of the weirs 22A and 28 extend in a cross-machine direction such that the coating chamber 14A is bounded by the weirs 22A and 28 and the web WA moving between the weirs 22A and 28. The first weir 22A defines a first overflow gap 30 which is disposed between the first weir 22A and the web WA moving past the first weir 22A. The second weir 28 defines a second overflow gap 32 which is disposed between the second weir 28 and the web WA moving past the second weir 28. The arrangement is such that during use of the apparatus 10A, when the web WA moves past the coating chamber 14A, coating material is coated onto the web WA while excess coating material 34 and 36 overflows through the first and second gaps 30 and 32 for recirculation through the coating chamber 14A. A resilient blade 24A is disposed downstream relative to the second weir 28. The blade 24A cooperates with the coating material coated onto the web WA such that the pressure exerted by the coating material on the blade 24A is less than the pressure of the coating material within the coating chamber 14A, so that mottling and streaking of the resultant web is inhibited while maintaining minimum pressure on the blade 24A.

Figure 3:
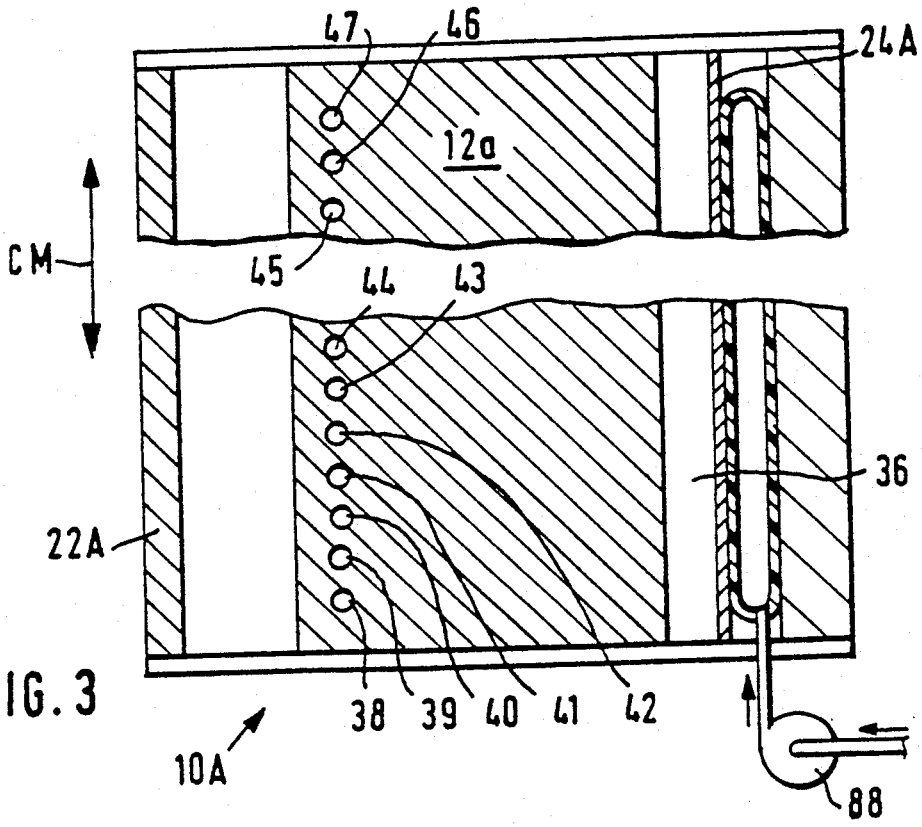
FIG. 3 is a sectional view taken on the line 3—3 of FIG. 2.

FIG. 3 is an enlarged sectional view taken on the line 3—3 of FIG. 2 and shows the short dwell coater apparatus 10A as including a plurality of holes 38, 39, 40, 41, 42, 43, 44, 45, 46, 47 defined by the housing 12A. The plurality of holes 38-47 extend from the coating chamber 14A to the pressurized source 16A for regulating the flow of coating material from the source 16A to the coating chamber 14A.

Figure 4:
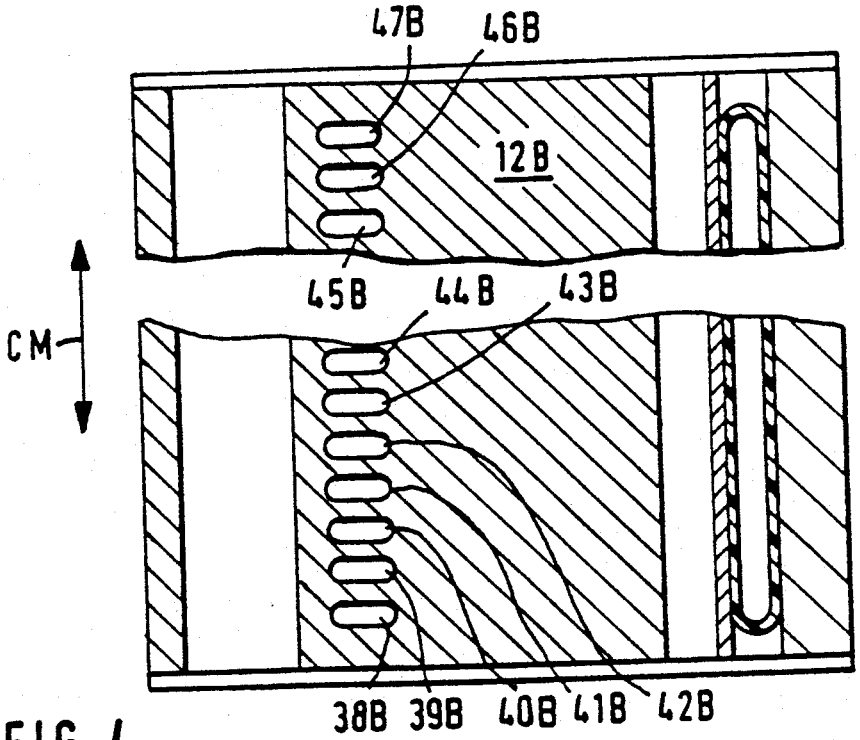
FIG. 4 is a similar view to that shown in FIG. 3 but shows a plurality of slots.

FIG. 4 is a similar view to that shown in FIG. 3 but shows an alternative embodiment of the present invention in which the housing 12B defines a plurality of slots 38B, 39B, 40B, 41B, 42B, 43B, 44B, 45B, 46B, 47B which extend from the coating chamber to the pressurized source for regulating the flow of coating material from the source to the coating chamber.

Figure 5:
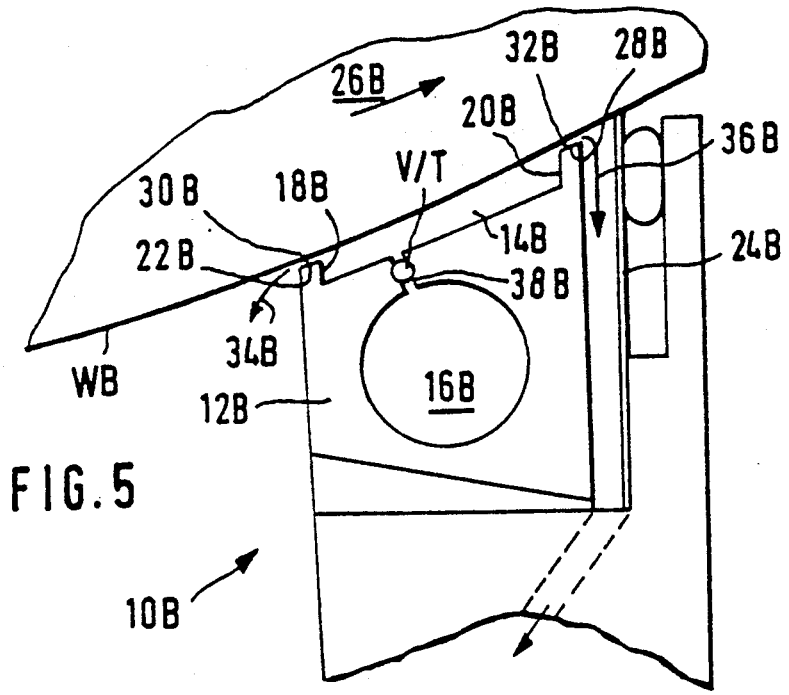
FIG. 5 is a side-elevational view of a further embodiment of the present invention including a control means.

FIG. 5 is a similar view to that shown in FIG. 2 but shows another embodiment of the present invention in which the housing 12B also includes control means V/T disposed between the pressurized source 16B and the coating chamber 14B for providing a constant flow of the coating material from the source 16B to the coating chamber 14B.

Figure 6:
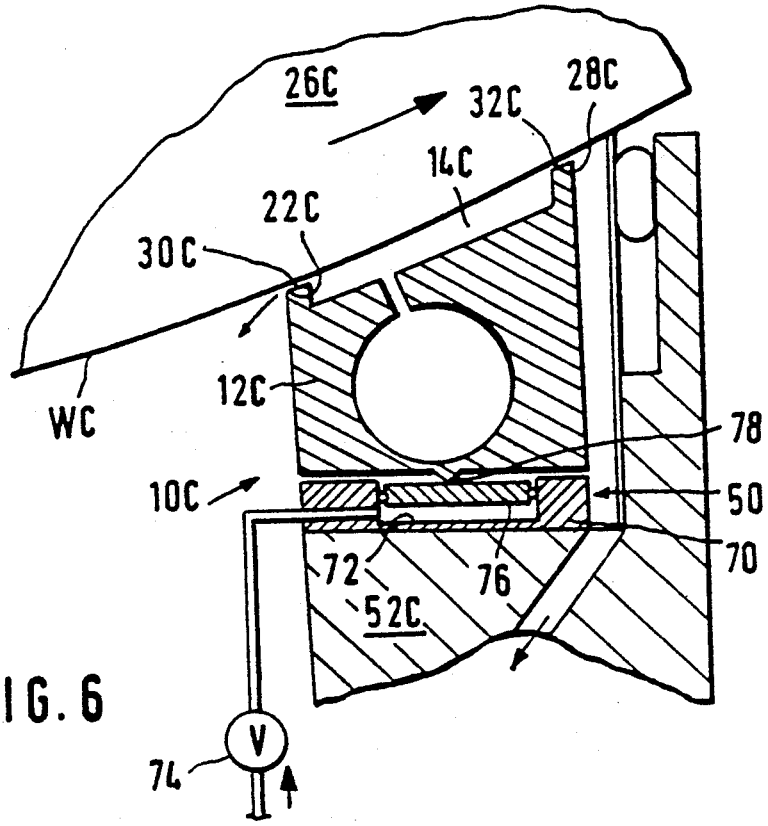
FIG. 6 is a side-elevational view of another embodiment of the present invention including a piston.

In another embodiment of the present invention, as shown in FIG. 6, the apparatus 10C includes overflow control means generally designated 50 connected to the housing 12C for controllably urging the housing 12C and the first and second weirs 22C and 28C radially relative to the backing roll 26C for controlling the first and second gaps 30C and 32C such that the pressure within the coating chamber 14C is controlled. The arrangement is such that when the weirs 22C and 28C are urged towards the web WC, the gaps 30C and 32C are decreased and the pressure within the coating chamber 14C is increased.

In one embodiment of the present invention, as shown in FIG. 2, the overflow control means generally designated 50A also includes a frame 52 and a wedge-shaped member 54 which is disposed between the frame 52 and the housing 12A. The wedge-shaped member 54 cooperates with the frame 52 and the housing 12A such that when the wedge-shaped member 54 is moved between the frame 52 and the housing 12A, the housing 12A is moved substantially radially as indicated by the arrow 56 relative to the backing roll 26A.

Figure 7:
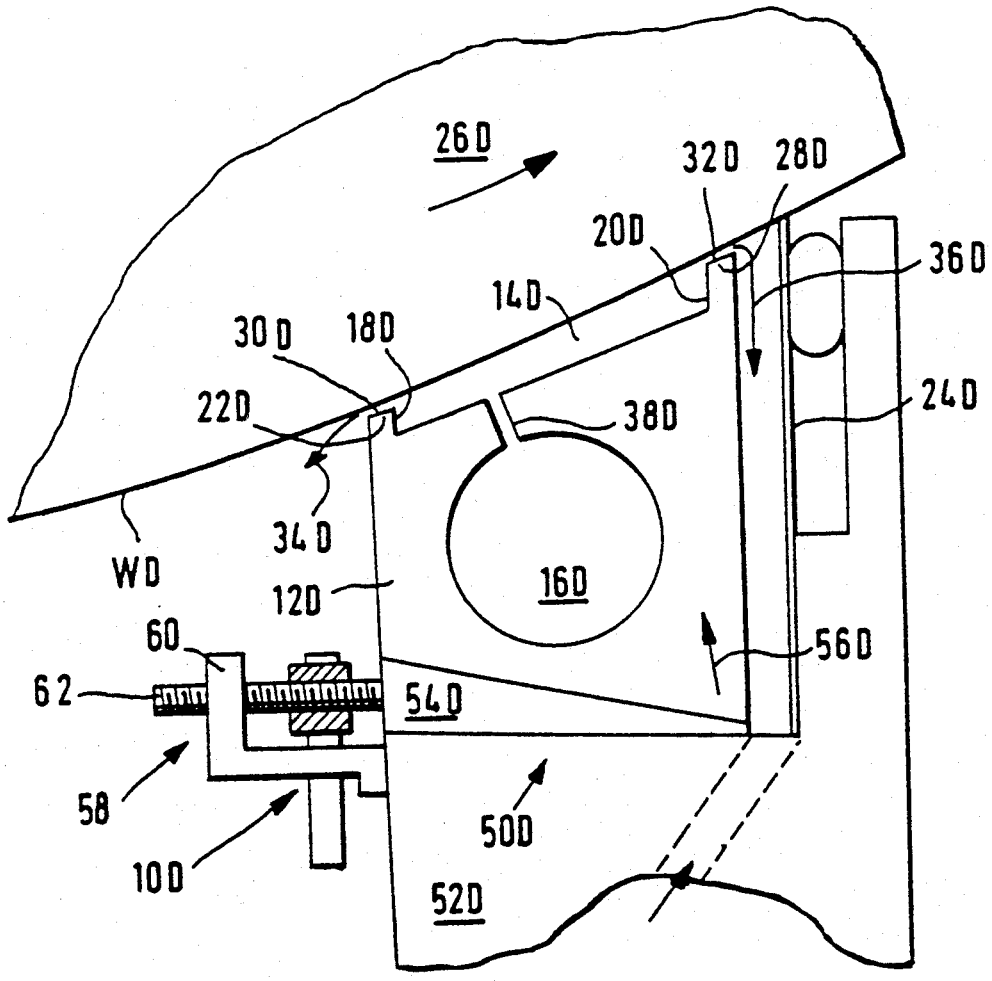
FIG. 7 is a side-elevational view of yet another embodiment of the present invention including a screw adjustable means.

In an alternative embodiment of the present invention, as shown in FIG. 7, the overflow control means 50D also includes adjustable means generally designated 58 which extend between the wedge-shaped member 54D and the frame 52D. The adjustable means 58 threadably cooperates with the frame 52D such that when the adjustable means 58 is rotated, the wedge-shaped member 54D is moved relative to the housing 12D for controlling the pressure within the coating chamber 14D.

More particularly, as shown in FIG. 7, the overflow control means 58 also includes a frame extension 60 and screw adjustable means 62 which extends between the frame extension 60 and the wedge-shaped member 54D for moving the housing 12D relative to the backing roll 26D for controlling the pressure within the coating chamber 14D.

As shown in FIG. 6, the overflow control means 50 includes a frame 52C and a hydraulically operated ram 70 which extends between the frame 52C and the housing 12C for moving the housing 12C relative to the backing roll 26C for controlling the pressure within the coating chamber 14C.

More specifically, as shown in FIG. 6, the ram 70 defines a cylinder 72 which is controllably connected to a source of hydraulic pressure 74. A piston 76 slidably cooperates with the cylinder 72. The housing 12C also defines a pivotal bearing 78. The pivotal bearing 78 pivotally cooperates with the piston 76 such that the housing 12C is controllably moved relative to the backing roll 26C for controlling the pressure within the coating chamber 14C.

As shown in FIG. 2, the blade 24A has a proximal and a distal end 80 and 82, with the proximal end 80 being secured to the frame 52. The distal end 82 cooperates with the applied coating material.

Regulating means generally designated 84 are disposed between the proximal and distal ends 80 and 82 of the blade. The regulating means 84 cooperate with the blade 24A and the frame 52 for regulating the pressure applied by the distal end 82 of the blade 24A to the applied coating. The pressure applied to the distal end 82 of the blade 24A by the applied coating material is substantially the same as the pressure of the coating material being recirculated from the second weir 28 to the coating chamber 14A. More specifically, the regulating means 84 includes a pneumatic tube 86 extending between the blade 24A between the proximal and distal ends 80 and 82 thereof. The tube 86 is connected to a controllable source of pressurized air 88 as shown in FIGS. 2 and 3.

The pressure within the coating chamber 14A is within the range ten to fifty pounds per square inch and the pressure of the coating material overflowing from the second gap 32 and contacting the distal end 82 of the blade 24A is substantially atmospheric such that the pressure of the coating material contacting the blade 24A is not effected by the pressure within the coating chamber 14A.

The present invention provides a short dwell coater apparatus that overcomes the problems of mottling and streaking associated with the prior art proposals, and maintains a relatively low pressure adjacent to the coating blade, so that the pressure within the coating chamber does not affect the controllability of the resilient blade.

What is claimed is:

1. A short dwell coater apparatus for coating a web with a coating material, said web moving contiguously with a rotating backing roll, said apparatus comprising:

a housing disposed on the opposite side of the web relative to the backing roll, said housing defining a coating chamber having an upstream and a downstream end, said chamber being connected to a pressurized source of the coating material, said chamber being exposed to the web such that the web supported by the backing roll is coated with the coating material during passage of the web past said coating chamber, said upstream and downstream ends of said coating chamber defining a first and second weir respectively, each of said weirs extending in a cross-machine direction such that said coating chamber is bounded by said weirs and the web moving between said weirs;

said first weir defining a first overflow gap disposed between said first weir and the web moving past said first weir;

said second weir defining a second overflow gap disposed between said second weir and the web moving past said second weir, the arrangement being such that during use of the apparatus, when the web moves past said coating chamber, coating material is coated onto the web while excess coating material overflows through said first and second gaps for recirculation through said coating chamber;

a resilient blade disposed downstream relative to said second weir, said blade cooperating with the coating material coated onto the web such that the pressure exerted by the coating material on said blade is less than the pressure of the coating material within said coating chamber, so that mottling and streaking of the resultant web is inhibited, while maintaining minimum pressure on said blade; and said apparatus further including: overflow control means connected to said housing for controllably urging said housing and said first and second weirs radially relative to the backing roll for controlling said first and second gaps such that the pressure within said coating chamber is controlled, the arrangement being such that when said weirs are urged towards the web, said gaps are decreased and the pressure within said coating chamber is increased.

2. A short dwell coater apparatus as set forth in claim 1, wherein said housing further defines a plurality of holes extending from said coating chamber to said pressurized source for regulating the flow of coating material from said source to said coating chamber.

3. A short dwell coater apparatus as set forth in claim 1, wherein said housing further defines a plurality of slots extending from said coater chamber to said pressurized source for regulating the flow of coating material from said source to said coating chamber.

4. A short dwell coater apparatus as set forth in claim 1, wherein said housing further defines a plurality of capillary tubes extending from said coating chamber to said pressurized source regulating the flow of coating material from said source to said coating chamber.

5. A short dwell coater apparatus as set forth in claim 1, wherein said housing further includes: control means disposed between said source and said coating chamber for providing a constant flow of the coating material from the source to said coating chamber.

6. A short dwell coater apparatus for coating a web with a coating material, said web moving contiguously with a rotating backing roll, said apparatus comprising:

a housing disposed on the opposite side of the web relative to the backing roll, said housing defining a coating chamber having an upstream and a downstream end, said chamber being connected to a pressurized source of the coating material, said chamber being exposed to the web such that the web supported by the backing roll is coated with a coating material during passage of the web past said coating chamber;

said upstream and downstream end of said coating chamber defining a first and second weir respectively, each of said weirs extending in a cross-machine direction such that said coating chamber is bounded by said weirs and the web moving between said weirs;

said first weir defining a first overflow gap disposed between said first weir and the web moving past said first weir;

said second weir defining a second overflow gap disposed between said second weir and the web moving past said second weir, the arrangement being such that during use of the apparatus, when the web moves past said coating chamber, coating material is coated onto the web while excess coating material overflows through said first and second gaps for recirculation through said coating chamber;

a resilient blade disposed downstream relative to said weir, said blade cooperating with the coating material coated onto the web such that the pressure exerted by the coating material on said blade is less than the pressure of the coating material within said coating chamber, so that mottling and streaking of the resultant web is inhibited, while maintaining minimum pressure on said blade;

overflow control means connected to said housing for controllably urging said housing and said first and second weirs radially relative to the backing roll for controlling said first and second gaps such that the pressure within said coating chamber is controlled, the arrangement being such that when said weirs are urged towards the web, said gaps are decreased and the pressure within said coating chamber is increased; and said overflow control means further including:

a frame, said frame defining a cylinder controllably connected to a source of hydraulic pressure;

a piston slidably cooperating within said cylinder;

said housing further defining a pivotal bearing, said pivotal bearing pivotally cooperating with said piston such that said housing is controllably moved relative to the backing roll for controlling the pressure within said coating chamber.

7. A short dwell coater apparatus as set forth in claim 1, wherein said apparatus further includes:

a frame;

overflow control means disposed between said frame and said housing for controllably moving said housing relative to said frame for controlling the pressure within said coating chamber;

said blade having a proximal and a distal end, said proximal end being secured to said frame, said distal end cooperating with the applied coating material;

regulating means disposed between said proximal and distal ends of said blade, said regulating means cooperating with said blade and said frame for regulating the pressure applied by said distal end of said blade to the applied coating, the pressure applied to said distal end of said blade by the applied coating material being substantially the same pressure as the pressure of the coating material being recirculated from said second gap to said coating chamber.

8. A short dwell coater apparatus as set forth in claim 1, wherein said regulating means includes:

a pneumatic tube extending between said frame and said blade between said proximal and distal ends thereof, said tube being connected to a controllable source of pressurized air.

9. A short dwell coater apparatus as set forth in claim 1, wherein said pressure within said coating chamber is within the range 10–50 pounds per square inch and the pressure of the coating material overflowing through said second gap and contacting said blade is substantially atmospheric, such that the pressure of the coating material contacting said blade is unaffected by the pressure within said coating chamber.

10. A short dwell coater apparatus for coating a web with a coating material, said web moving contiguously with a rotating backing roll, said apparatus comprising:

a housing disposed on the opposite side of the web relative to the backing roll, said housing defining a coating chamber having an upstream and a downstream end, said chamber being connected to a pressurized source of the coating material, said chamber being exposed to the web such that the web supported by the backing roll is coated with the coating material during passage of the web past said coating chamber;

said upstream and downstream ends of said coating chamber defining a first and second weir respectively, each of said weirs extending in a cross-machine direction such that said coating chamber is bounded by said weirs and the web moving between said weirs;

said first weir defining a first overflow gap disposed between said first weir and the web moving past said first weir;

said second weir defining a second overflow gap disposed between said second weir and the web moving past said second weir, the arrangement being such that during use of the apparatus, when the web moves past said coating chamber, coating material is coated onto the web while excess coating material overflows through said first and second gaps for recirculation through said coating chamber;

a resilient blade disposed downstream relative to said second weir, said blade cooperating with the coating material coated onto the web such that the pressure exerted by the coating material on said blade is less than the pressure of the coating material within said coating chamber, so that mottling and streaking of the resultant web is inhibited, while maintaining minimum pressure on said blade;

overflow control means connected to said housing for controllably urging said housing and said first and second weirs radially relative to the backing roll for controlling said first and second gaps such that the pressure within said coating chamber is controlled, the arrangement being such that when said weirs are urged towards the web, said gaps are decreased and the pressure within said coating chamber is increased; and said overflow control means further including:

a frame;

a wedge-shaped member disposed between said frame and said housing, said wedge-shaped member cooperating with said frame and said housing such that when said wedge-shaped member is moved between said frame and said housing, said housing is moved radially relative to the backing roll.

11. A short dwell coater apparatus as set forth in claim 10, wherein said overflow control means further includes:

adjustable means extending between said wedge-shaped member and said frame, said adjustable means threadably cooperating with said frame such that when said adjustable means is rotated, said wedge-shaped member is moved relative to said housing for controlling the pressure within said coating chamber.

12. A short dwell coater apparatus for coating a web with a coating material, said web moving contiguously with a rotating backing roll, said apparatus comprising:

a housing disposed on the opposite side of the web relative to the backing roll, said housing defining a coating chamber having an upstream and a downstream end, said chamber being connected to a pressurized source of the coating material, said chamber being exposed to the web such that the web supported by the backing roll is coated with a coating material during passage of the web past said coating chamber;

said upstream and downstream ends of said coating chamber defining a first and second weir respectively, each of said weirs extending in a cross-machine direction such that said coating chamber is bounded by said weirs and the web moving between said weirs;

said first weir defining a first overflow gap disposed between said first weir and the web moving past said first weir;

said second weir defining a second overflow gap disposed between said second weir and the web moving past said second weir, the arrangement being such that during use of the apparatus, when the web moves past said coating chamber, coating material is coated onto the web while excess coating material overflows through said first and second gaps for recirculation through said coating chamber;

a resilient blade disposed downstream relative to said weir, said blade cooperating with the coating material coated onto the web such that the pressure exerted by the coating material on said blade is less than the pressure of the coating material within said coating chamber, so that mottling and streaking of the resultant web is inhibited, while maintaining minimum pressure on said blade;

overflow control means connected to said housing for controllably urging said housing and said first and second weirs radially relative to the backing roll for controlling said first and second gaps such that the pressure within said coating chamber is controlled, the arrangement being such that when said weirs are urged towards the web, said gaps are decreased and the pressure within said coating chamber is increased; and said overflow control means further including:

a frame;

screw adjustable means extending between said frame and said housing for moving said housing relative to the backing roll for controlling the pressure within said coating chamber.

13. A short dwell coater apparatus for coating a web with a coating material, said web moving contiguously with a rotating backing roll, said apparatus comprising:

a housing disposed on the opposite side of the web relative to the backing roll, said housing defining a coating chamber having an upstream and a downstream end, said chamber being connected to a pressurized source of the coating material, said chamber being exposed to the web such that the web supported by the backing roll is coated with a coating material during passage of the web past said coating chamber;

said upstream and downstream ends of said coating chamber defining a first and second weir respectively, each of said weirs extending in a cross-machine direction such that said coating chamber is bounded by said weirs and the web moving between said weirs;

said first weir defining a first overflow gap disposed between said first weir and the web moving past said first weir;

said second weir defining a second overflow gap disposed between said second weir and the web moving past said second weir, the arrangement being such that during use of the apparatus, when the web moves past said coating chamber, coating material is coated onto the web while excess coating material overflows through said first and second gaps for recirculation through said coating chamber;

a resilient blade disposed downstream relative to said weir, said blade cooperating with the coating material coated onto the web such that the pressure exerted by the coating material on said blade is less than the pressure of the coating material within said coating chamber, so that mottling and streaking of the resultant web is inhibited, while maintaining minimum pressure on said blade;

overflow control means connected to said housing for controllably urging said housing and said first and second weirs radially relative to the backing roll for controlling said first and second gaps such that the pressure within said coating chamber is controlled, the arrangement being such that when said weirs are urged towards the web, said gaps are decreased and the pressure within said coating chamber is increased; and said overflow control means further including:

a frame;

a hydraulically operated ram extending between said frame and said housing for moving said housing relative to the backing roll for controlling the pressure within said coating chamber.

* * * * *